US006681433B1

(12) United States Patent
Ruuska et al.

(10) Patent No.: US 6,681,433 B1
(45) Date of Patent: Jan. 27, 2004

(54) SWEEPING UNIT

(75) Inventors: Mauno Olavi Ruuska, Vammala (FI); Janko Tuskan, Furtwangen (DE); Clemens Rosa, Grafenhausen (DE)

(73) Assignees: Schmidt Holding GmbH, Blasien (DE); Patria Vammas Oy, Vammala (FI)

( * ) Notice: Subject to any disclaimer, the term of this patent is extended or adjusted under 35 U.S.C. 154(b) by 75 days.

(21) Appl. No.: 09/763,283

(22) PCT Filed: Jun. 15, 2000

(86) PCT No.: PCT/EP00/05487

§ 371 (c)(1),
(2), (4) Date: Jun. 7, 2001

(87) PCT Pub. No.: WO00/79059

PCT Pub. Date: Dec. 28, 2000

(30) Foreign Application Priority Data

Jun. 17, 1999 (DE) ..... 199 27 593

(51) Int. Cl.[7] ..... A46B 13/00; A46B 13/02
(52) U.S. Cl. ..... 15/82; 15/52.1
(58) Field of Search ..... 15/49.1, 50.1, 15/50.3, 52.1, 55, 82, 87, 98, 340.1, 340.3, 340.4

(56) References Cited

U.S. PATENT DOCUMENTS 5,015,300 A 5/1991 Leers
5,295,277 A * 3/1994 Koenigs et al. ..... 15/83
5,369,832 A 12/1994 Hagger
5,426,805 A 6/1995 Fisher

FOREIGN PATENT DOCUMENTS

| | | |
|---|---|---|
| DE | 2455200 | 5/1976 |
| DE | 2821627 | 11/1979 |
| DE | 3740215 | 6/1988 |
| EP | 0189371 | 7/1986 |
| EP | 0372258 | 6/1990 |
| EP | 0843047 | 5/1998 |

* cited by examiner

*Primary Examiner*—Terrence R. Till
(74) *Attorney, Agent, or Firm*—Jordan and Hamburg LLP

(57) ABSTRACT

A sweeping unit has a supporting frame and at least one motor-driven rotary brush which is rotationally mounted about an longitudinal axis thereof The supporting frame is provided with supporting wheels, and a distance of the wheels from the axis of the rotary brush is controlled by an adjusting device having at least one hydraulic adjusting cylinder and a control device. A supply cylinder is hydraulically connected to the at least one adjusting cylinder and has a piston, or other signalling component, connected to a metering device and/or distance measurement device. A signal from the metering and/or distance measurement device is connected to the control unit. A working area of the supply cylinder communicates hydraulically with the at least one adjusting cylinder and has a smaller cross-sectional surface area than that of the at least one adjusting cylinder. Alternatively, the piston of the supply cylinder is connected to a mechanical adjusting drive mechanism.

24 Claims, 1 Drawing Sheet

SWEEPING UNIT

BACKGROUND

The present invention relates to a sweeping unit for mounting on a carrier vehicle or on a trailer, comprising a carrying frame and at least one motor-driven rotary brush mounted in the carrying frame such that it can be rotated about its longitudinal axis, the carrying frame having supporting wheels, of which the vertical distance from the axis of the rotary brush can be changed by means of an adjusting unit, which comprises at least one hydraulic adjusting cylinder and a control apparatus.

Various designs of sweeping units of the type specified above are known, for example from European Patent 0372258 and German Offenlegungsschrift 3740215. Also known are sweeping units which have a construction essentially of a generic type, but differ therefrom in that a hydraulic adjusting cylinder, rather than being set via control apparatus, is part of a hydraulic regulating circuit, and in that, furthermore, a carrying frame does not have supporting wheels. Sweeping units of this type are disclosed in, for example, German Offenlegungsschriften 2455200 and 2821627 and European Patent Applications 0189371 and 0843047.

For all the sweeping units known from the publications specified above, correct setting of sweeping-level width is extremely important for an efficient sweeping operation which, at the same time, does not adversely affect the materials. Thus, as is explained in detail in European Patent 0372258, an optimum sweeping-level width is characterized by a good cleaning result with a low level of bristle wear. If the sweeping-level width is below the optimum value, cleaning capacity can noticeably decrease. With a sweeping-level width above the optimum value, in contrast, bristle wear noticeably increases without any notable improvement to cleaning result.

It is not possible with any of the sweeping units known from the publications specified above for the sweeping-level width to be set with the desired level of accuracy. This applies particularly to the prior art according to the generically determinative documents. It is to be taken into consideration in this context that, with a conventional rotary brush of a diameter of 914 mm, a height adjustment of 1 mm means a change in sweeping level of approximately 60 mm. The fact that values of between 60 mm and 100 mm are considered as a suitable sweeping-level width makes it clear which requirements are to be met in practice by the accuracy of the adjusting unit.

SUMMARY

Against the backdrop of the prior-art disadvantage explained above, the object of the present invention is to provide a sweeping unit of the generic type in which an optimum sweeping level can be set with a high level of accuracy.

This object is achieved according to the present invention in that hydraulically connected to at least one adjusting cylinder is a supply cylinder having a piston, or other signal generator, connected to a counting and/or displacement measuring device connected to a control apparatus, or a mechanical adjusting drive. The supply cylinder has a hydraulic operating chamber which communicates with the at least one adjusting cylinder and has a smaller cross-sectional surface area than the at least one adjusting cylinder.

The supply cylinder effects volumetric proportioning of hydraulic fluid to the at least one adjusting cylinder, this corresponding to advancement movement of the at least one adjusting cylinder from a reference position into an operating position, which corresponds to the optimum sweeping-level width. The reference position here may correspond to various characteristic positions of the rotary brush, relative to the surface which is to be cleaned, with reference to which the control apparatus calculates an advancement movement of the at least one adjusting cylinder which is necessary in order to bring the rotary brush into the operating position, which is characterized by the optimum sweeping-level width. An initial ground-contact position of the rotary brush and the corresponding position of the at least one adjusting cylinder are particularly preferably used as the reference position because this automatically compensates for bristle wear (see below). A bypass line to the supply cylinder is particularly preferably provided since the supply cylinder is required merely for the precise lowering of the rotary brush from its ground-contact position into its operating position. There is no need for a volumetric determination of the hydraulic-fluid volume which is fed to the at least one adjusting cylinder or flows out of the same, either during lowering of the rotary brush into the ground-contact position or during raising of the rotary brush, respectively. The above-mentioned configuration of a hydraulic system with the supply cylinder results in it being possible for the at least one adjusting cylinder to be set particularly precisely.

Although it is conceivable, within the context of the above-mentioned development of the present invention, for a mechanical adjusting drive to act on the piston of the supply cylinder, with the result that the supply cylinder itself performs the function of a pump, it is particularly preferable for the supply cylinder to be connected between a hydraulic pump and the at least one adjusting cylinder. It follows along in this case, the volume of the hydraulic fluid fed to the at least one adjusting cylinder being determined by the number of strokes of the supply cylinder and/or—in the case of incomplete strokes—by the displacement of the piston of the supply cylinder.

According to another preferred development of the invention, there is provided a sensor which senses a driving torque or a driving power of the rotary brush, or a variable linked thereto. A signal from the sensor is connected to the control apparatus, and the control apparatus determines the operating position of the adjusting element. The operation position corresponding to the optimum sweeping-level width is set as a function of the ground-contact position of the adjusting element. The ground-contact position is determined during lowering of the rotary brush, by an abrupt rise of the sensor signal.

In the sweeping unit developed in this way, the actual rotary-brush diameter, which is dependent on the bristle wear, is automatically taken into account for setting the position of the rotary brush relative to the surface which is to be cleaned, in that during the individual sweeping operation, the ground contact of the rotary brush and the corresponding ground-contact position of the adjusting element are used as reference points for the operating position of the adjusting element, the operating position corresponding to the optimum sweeping-level width. The ground contact of the rotary brush, during lowering of the latter, is determined here by an abrupt rise of the sensor signal which is emitted by the sensor which senses the driving torque or the driving power of the rotary brush or a variable linked thereto.

Problems known to occur with sweeping units according to the prior art do not arise in a sweeping unit as described above. Unlike the case in German Offenlegungsschriften 2455200 and 2821627 and in EP-A 0189371 and 0843047, the sweeping-level width set by the control apparatus is not dependent on the surface conditions, in particular the roughness of the surface which is to be cleaned, nor, unlike the case in EP-B 0372258 and in German Offenlegungsschrift 3740215, is a complicated measuring-sensor arrangement which is susceptible to malfunctioning necessary. Nevertheless, the setting of the sweeping-level width is based not on an average degree of rotary-brush wear, which is dependent on the running performance of the relevant rotary brush, but on the actual degree of wear. Consequently, this development of the invention provides a sweeping unit in which the optimum sweeping level can automatically be set precisely with extremely low outlay on apparatus. The sweeping unit of the present invention is thus distinguished by a robust construction which is not susceptible to malfunctioning.

The above-described development of the invention can advantageously be used if the operating position of the adjusting element is determined, in the control apparatus, from the ground-contact position or other reference position of the adjusting element by the addition of a constant variable. In this case, in other words, the rotary brush, during the sweeping operation, would be lowered in each case into a position which is located a certain distance (e.g. 2 mm) below the ground-contact position. Although, as a result of the geometrical relationships, this would result, with continuing wear of the rotary brush, in a gradual reduction in the sweeping-level width, it would be compensated—at least partially—by an increasing hardness of the brush, so that the cleaning result would essentially stay the same.

In contrast, however, another preferred development is distinguished in that an adjusting-element advancement movement, by means of which the operating position of the adjusting element differs from the ground-contact position thereof, is dependent on the actual diameter of the rotary brush. In this case, the control apparatus comprises a corresponding compensation circuit, for example in the form of a characteristic curve, which specifies the advancement movement, i.e. the difference between the operating position and ground-contact position of the adjusting element, in dependence on an actual diameter of the rotary brush. The actual diameter may be derived directly from the ground-contact position of the adjusting element since—with supporting wheels resting on the surface which is to be cleaned—each diameter of the rotary brush has precisely one ground-contact position of the adjusting element corresponding to it. Other suitable measuring devices which are intended for determining the diameter of the rotary brush, and likewise evaluate the position of the rotary brush relative to the carrying frame in the ground-contact position of the rotary brush, can be used in the same way. These include, in particular, an angle-measuring instrument which determines an angular position of at least one carrying arm of the rotary brush relative to a further component of the carrying frame. The critical factor is that the diameter of the rotary brush, rather than being measured directly—via sensors—in each case, is derived from the position of the rotary brush at the moment at which it comes into contact with the ground, and thus indirectly utilizing the signal of the ground-contact sensor.

The present invention is explained in more detail herein below with reference to the drawing.

DETAILED DESCRIPTION

Figure 1:
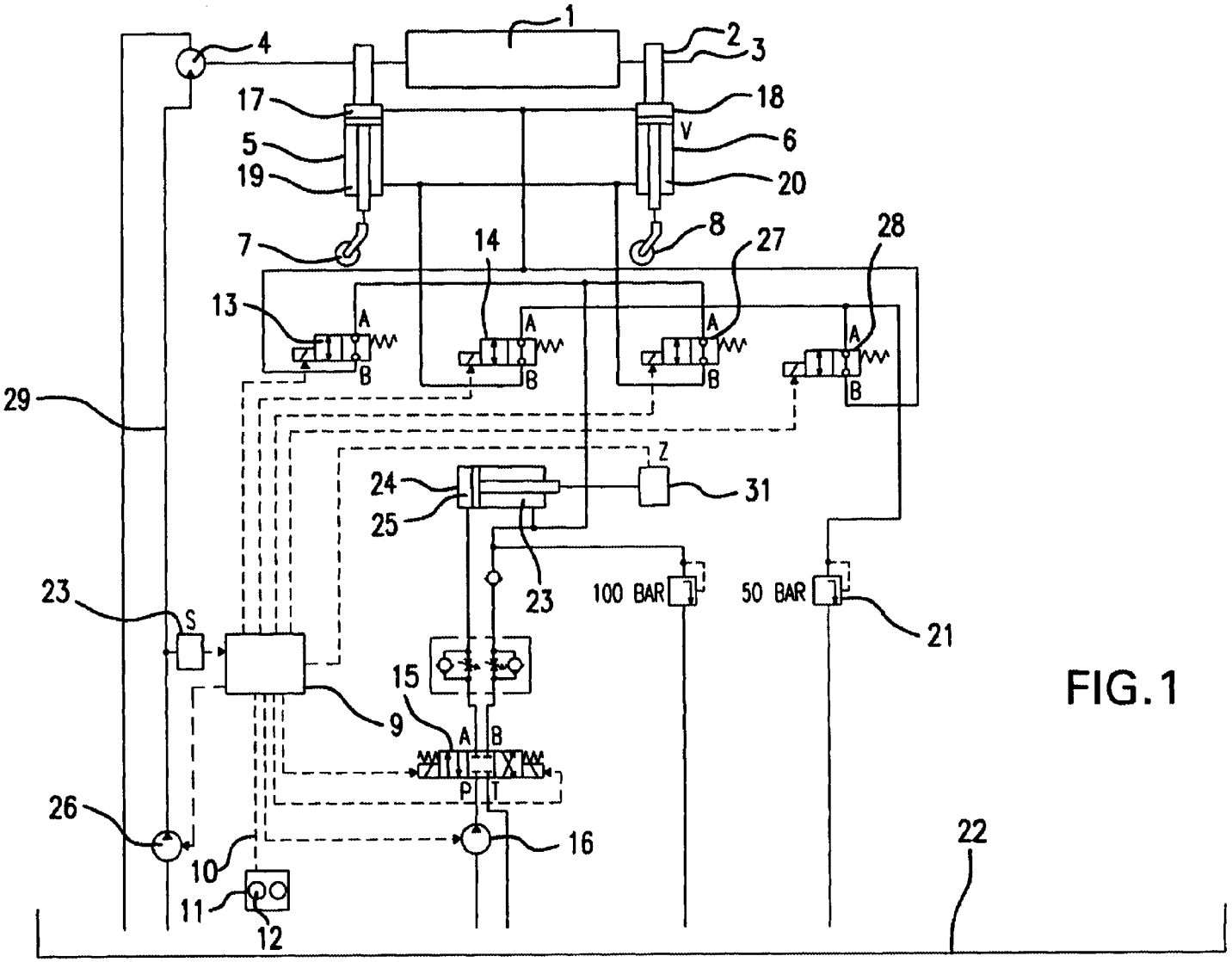
FIG. 1 shows a hydraulic circuit diagram of a preferred embodiment of a sweeping unit according to the present invention.

Referring to FIG. 1, a sweeping unit comprises a rotary brush 1 which is mounted within a carrying frame 2 such that it can be rotated about an axis 3 thereof, and is driven by a hydraulic motor 4. The carrying frame 2, comprises two hydraulic adjusting cylinders 5 and 6, which form adjusting elements V, a piston rod of each of the two hydraulic adjusting cylinders 5 and 6 being connected to a supporting wheel 7 or 8. The design—only schematically illustrated—is such that a vertical distance between the supporting wheels 7, 8 and the axis 3 of the rotary brush 1 can be changed by means of the adjusting cylinders 5 and 6. Such designs are known to a sufficient extent, so that there is no need for them to be explained in any more detail.

The sweeping unit itself is suspended on a carrier vehicle by means of a carrying arrangement—not illustrated. The carrying arrangement here allows the sweeping unit to be raised into a transporting position and lowered into an operating position, in which the supporting wheels 7 and 8 roll on the surface which is to be cleaned. This also forms part of the prior art and thus need not be explained here.

The functioning of the sweeping unit is controlled by a control apparatus 9 which is connected to operating console 11 via a control line 10. When the sweeping unit is set in operation via a corresponding switch 12 of the operating console 11, the following steps proceed within the hydraulics controlled by the control apparatus 9:

Valves 13 and 14 are switched from their blocking position into their throughflow position, control valve 15 is switched from a blocking position into a crossover position, in which it connects to one another connections P and B, on the one hand, and A and T on the other hand, and a pump 16 is set in operation. In this way, hydraulic operating chambers 17, 18 of the adjusting cylinders 5 and 6 are filled with hydraulic fluid, and piston rods of the adjusting cylinders 5 and 6 are extended into their maximum position. Hydraulic fluid which is present in hydraulic operating chambers 19 and 20 is displaced into a sump 22 in the process via the valve 14 and the backpressure valve 21. At the same time, a hydraulic operating chamber 23 of a supply cylinder 24 is filled, as a result of which the piston of the supply cylinder 24 is brought into its left-hand end position, hydraulic fluid which is present in a hydraulic operating chamber 25 being displaced into the sump 22 in the process via the control valve 15. Then the valves 13 and 14 are brought into their locking position, and the sweeping unit is lowered, by means of the carrying apparatus (not illustrated), until the supporting wheels 7 and 8 rest on the surface which is to be cleaned. The carrying apparatus is then switched into a floating position in order that the sweeping unit can follow unevenness in the ground.

The hydraulic pump 26 which drives the hydraulic motor 4 is then switched on, with the result that the rotary brush 1 is made to rotate. Valves 27 and 28 are switched into their throughflow position. In this way, hydraulic fluid passes into the hydraulic operating chambers 19 and 20 of the adjusting cylinders 5 and 6 via the pump 16 and the control valve 15, which is still switched into its crossover position. The piston rods of the adjusting cylinders retract slowly, the hydraulic fluid which is present in the hydraulic operating chambers 17 and 18 being displaced into the sump 22 via the (open) valve 28 and the backpressure valve 21. This results in the sweeping roller 1 being lowered gradually in the direction of the surface which is to be cleaned.

As soon as the rotary brush 1, within the context of this lowering movement, comes into contact with the surface which is to be cleaned and, in this way, is braked beyond an idling braking torque, pressure in a pressure line 29, which connects the hydraulic pump 26 and the hydraulic motor 4 to one another, rises abruptly. This rise in pressure is registered by a sensor S, in the form of a pressure sensor 30, which sends a corresponding signal to the control apparatus 9. The control apparatus 9 then switches the control valve 15 from the crossover position into a parallel through-passage position, in which it connects to one another the connections A and P, on the one hand, and B and T on the other hand. The hydraulic operating chamber 25 of the supply cylinder 24 is acted upon as a result, and the hydraulic fluid which is present in the hydraulic operating chamber 23 is displaced into the hydraulic operating chambers 19 and 20 of the adjusting cylinders 5 and 6 via the (open) valve 27. A predetermined volume of the hydraulic operating chamber 23 of the supply cylinder 24 results in a precisely defined shortening of the adjusting cylinders 5 and 6, and thus in a precisely defined lowering of the rotary brush 1.

If the optimum sweeping-level width has not yet been reached, the two valves 27 and 28 are closed and the control valve 15 is brought into its crossover position. As a result, the hydraulic operating chamber 23 of the supply cylinder 24 is filled with hydraulic fluid again and the above-described operation—opening of the valves 27 and 28 and changeover of the control valve 15 into its parallel through-passage position—can be repeated.

A number of strokes of the supply cylinder 24 which are necessary in order to bring the rotary brush 1 from its ground-contact position into its operating position depend, in particular, is based on a hydraulic reduction ratio between the supply cylinder 24 and the adjusting cylinders 5 and 6. The greater the reduction ratio, the more precisely is it possible to set the position of the rotary brush 1 relative to the surface which is to be cleaned. The piston rod of the supply cylinder 24 acts on a counting device Z in the form of a pulse counter 31, which is connected to the control apparatus 9. If the number of strokes determined by the pulse counter 31 corresponds to the value predetermined by the control apparatus 9, all the valves 13, 14, 27 and 28 and the control valve 15 are closed and the hydraulic pump 16 is switched off.

At the end of the sweeping operation, via a corresponding switch on the operating console 11, the hydraulic pump 26 is switched off and the sweeping unit is raised via the carrying arrangement—not illustrated. This can be followed by the pistons of the adjusting cylinders 5 and 6 being extended, as explained above, by action on the hydraulic operating chambers 17 and 18 thereof This step may then be omitted at the beginning of the sweeping operation.

The above described operation (precision-adjustment lowering operation) can be reversed if valves 13 and 14 are activated instead of valves 27 and 28. This results in a precision-adjustment raising operation. This means that it is easily possible to compensate for disruptive external influences which do not change too quickly. For example, a plow-like arrangement, by way of its weight, has a very strong influence on the geometry of the vehicle frame in relation to the road and, correspondingly, the sweeping level.

What is claimed is:

1. A sweeping unit for mounting on a carrier vehicle or a trailer, comprising:

a carrying frame and at least one motor-driven rotary brush mounted in said carrying frame such that the rotary brush can be-rotated about a longitudinal axis thereof, the carrying frame having supporting wheels;

an adjusting unit for adjusting a vertical distance of the supporting wheels from the axis of the rotary brush, the adjusting unit including:

at least one hydraulic adjusting cylinder for moving the supporting wheels relative to the axis of the rotary brush to set the vertical distance therebetween;

a supply cylinder having a piston and a hydraulic operating chamber communicating with the at least one adjusting cylinder and having a smaller cross-sectional surface area than the at least one adjusting cylinder; and a control device for controlling drive of the supply cylinder based upon detected movement of the piston of the supply cylinder to set the vertical distance of the supporting wheels from the axis of the rotary brush.

2. The sweeping unit as claimed in claim 1, further comprising a hydraulic pump, the supply cylinder being connected between the hydraulic pump and the at least one adjusting cylinder, the hydraulic pump being controlled by the control device.

3. The sweeping unit as claimed in claim 2, wherein the control device includes:

a measuring device for detecting movement of said piston of the supply cylinder and generating a corresponding piston movement signal; and a controller for controlling operation of the supply cylinder based on the piston movement signal to set the vertical distance of the supporting wheels from the axis of the rotary brush.

4. The sweeping unit as claimed in claim 3, wherein the measuring device is a counter.

5. The sweeping unit as claimed in claim 3, wherein the measuring device is a displacement measurer.

6. The sweeping unit as claimed in claim 1 or claim 2, further comprising a control valve between the hydraulic pump and the supply cylinder, the changeover valve permitting action directly on the at least one adjusting cylinder, with the supply cylinder being bypassed, the control valve being controlled by the control device.

7. The sweeping unit as claimed in claim 6, wherein the control device includes:

a measuring device for detecting movement of said piston of the supply cylinder and generating a corresponding piston movement signal; and a controller for controlling operation of the supply cylinder based on the piston movement signal to set the vertical distance of the supporting wheels from the axis of the rotary brush.

8. The sweeping unit as claimed in claim 7, wherein the measuring device is a counter.

9. The sweeping unit as claimed in claim 7, wherein the measuring device is a displacement measurer.

10. The sweeping unit as claimed in claim 1 or claim 2, further comprising a sensor which senses the driving torque or the driving power of the rotary brush, or a variable linked thereto, and generates a corresponding signal which is fed to the control device, the control device determining an operating position of the rotary brush, said operating position corresponding to an optimum sweeping-level width, as a function of a ground-contact position of the rotary brush, said ground-contact position being characterized, during lowering of the rotary brush, by an abrupt rise of the sensor signal.

11. The sweeping unit as claimed in claim 10, further comprising a measuring arrangement for determining the diameter of the rotary brush and generating a corresponding diameter signal, the diameter signal being fed to the control device.

12. The sweeping unit as claimed in claim 11, wherein stored in the control device is a characteristic curve for advancement of the at least one hydraulic adjusting cylinder from the ground-contact position into the operating position, said advancement being dependent on an actual diameter of the rotary brush indicated by the diameter signal.

13. The sweeping unit as claimed in claim 12, wherein the control device includes:

a measuring device for detecting movement of said piston of the supply cylinder and generating a corresponding piston movement signal; and a controller for controlling operation of the supply cylinder based on the piston movement signal to set the vertical distance of the supporting wheels from the axis of the rotary brush.

14. The sweeping unit as claimed in claim 13, wherein the measuring device is a counter.

15. The sweeping unit as claimed in claim 13, wherein the measuring device is a displacement measurer.

16. The sweeping unit as claimed in claim 11, wherein the control device includes:

a measuring device for detecting movement of said piston of the supply cylinder and generating a corresponding piston movement signal; and a controller for controlling operation of the supply cylinder based on the piston movement signal to set the vertical distance of the supporting wheels from the axis of the rotary brush.

17. The sweeping unit as claimed in claim 16, wherein the measuring device is a counter.

18. The sweeping unit as claimed in claim 16, wherein the measuring device is a displacement measurer.

19. The sweeping unit as claimed in claim 10, wherein the control device includes:

a measuring device for detecting movement of said piston of the supply cylinder and generating a corresponding piston movement signal; and a controller for controlling operation of the supply cylinder based on the piston movement signal to set the vertical distance of the supporting wheels from the axis of the rotary brush.

20. The sweeping unit as claimed in claim 19, wherein the measuring device is a counter.

21. The sweeping unit as claimed in claim 19, wherein the measuring device is a displacement measurer.

22. The sweeping unit as claimed in claim 1, wherein the control device includes:

a measuring device for detecting movement of said piston of the supply cylinder and generating a corresponding piston movement signal; and a controller for controlling operation of the supply cylinder based on the piston movement signal to set the vertical distance of the supporting wheels from the axis of the rotary brush.

23. The sweeping unit as claimed in claim 22, wherein the measuring device is a counter.

24. The sweeping unit as claimed in claim 22, wherein the measuring device is a displacement measurer.

* * * * *